US011441858B2

(12) United States Patent
Borges et al.

(10) Patent No.: US 11,441,858 B2
(45) Date of Patent: Sep. 13, 2022

(54) PISTOL MULTI-FUNCTIONAL REAR RAIL MODULE

(71) Applicant: Polymer80, Inc., Dayton, NV (US)

(72) Inventors: David Borges, Fairfield, CA (US); Loran Kelley, Carson City, NV (US); Michael Guttridge, Dixon, CA (US); Grant Griffard, Soquel, CA (US)

(73) Assignee: POLYMER80, INC., Dayton, NV (US)

( * ) Notice: Subject to any disclaimer, the term of this patent is extended or adjusted under 35 U.S.C. 154(b) by 0 days.

(21) Appl. No.: 16/892,069

(22) Filed: Jun. 3, 2020

(65) Prior Publication Data

US 2020/0292255 A1 Sep. 17, 2020

Related U.S. Application Data

(63) Continuation of application No. 15/812,635, filed on Nov. 14, 2017, now Pat. No. 10,739,090.

(60) Provisional application No. 62/505,309, filed on May 12, 2017.

(51) Int. Cl.

| | |
|---|---|
| ***F41A 3/64*** | (2006.01) |
| ***F41A 3/66*** | (2006.01) |
| *F41C 3/00* | (2006.01) |

(52) U.S. Cl.

CPC ..... *F41A 3/64* (2013.01); *F41A 3/66* (2013.01); *F41C 3/00* (2013.01)

(58) Field of Classification Search

CPC ..... F41A 3/66; F41A 3/68; F41A 3/64; F41C 23/00

USPC ..... 42/71.01, 71.02

See application file for complete search history.

(56) References Cited

U.S. PATENT DOCUMENTS

| | | | | |
|---|---|---|---|---|
| 5,669,169 A * | 9/1997 | Schmitter | F41A 3/66 | 42/75.01 |
| 5,717,156 A * | 2/1998 | Lenkarski | F41A 3/64 | 42/15 |
| 6,401,379 B1 * | 6/2002 | Moon | F41A 3/66 | 42/71.01 |

FOREIGN PATENT DOCUMENTS

DE 380115 * 8/1923

OTHER PUBLICATIONS

Borges, David, "PF940 Pistol Frame—80% Milling Instructions". Jun. 9, 2016, Polymer80, All Pages, <https://www.polymer80.com/media/wysiwyg/porto/instructions/Polymer80-PF940-Instructions.pdf>, accessed Feb. 22, 2019. (Year: 2016).

* cited by examiner

*Primary Examiner* — Michael D David

(74) *Attorney, Agent, or Firm* — Bennet K. Langlotz; Langlotz Patent & Trademark Works, LLC

(57) ABSTRACT

The present invention provides a pistol with a frame having a rear grip, a trigger facility forward of the grip and an upper surface. An elongated slide is connected to the frame and operable to reciprocate along the upper surface. The frame defines a rear recess open at the upper surface. An insert is included having a major portion removably received in the rear recess and having a frame rail extending from the major portion above the upper surface. The frame rail is adapted to connect with the slide to constrain reciprocation.

10 Claims, 7 Drawing Sheets

PISTOL MULTI-FUNCTIONAL REAR RAIL MODULE

CROSS-REFERENCE TO RELATED APPLICATION

This application is a Continuation of U.S. patent application Ser. No. 15/812,635 filed on Nov. 14, 2017, entitled "Pistol Multi-Functional Rear Rail Module," which claims the benefit of U.S. Provisional Patent Application No. 62/505,309 filed on May 12, 2017, entitled "Pistol Multi-Functional Rear Rail Module," which are hereby incorporated by reference in their entirety for all that is taught and disclosed therein.

FIELD OF THE INVENTION

The present invention generally relates to firearms. More specifically, the present invention relates to firearm parts.

BACKGROUND OF THE INVENTION

The assembly of firearms from parts instead of purchasing a complete firearm has become popular with the purchasers of firearms. It has become a hobby that allows the firearm to be customized with the desired features by the purchaser. When a purchaser buys a completed firearm from the dealer, that purchaser usually ends up spending more money on customizing the firearm, while discarding parts that originally were part of the firearm. Popular changes to completed firearms are trigger replacement, barrel replacement, sight replacement and weight reduction modifications.

The trend is to have firearm receivers and frames available for sale that a purchaser can buy. Then, the purchaser buys the other required firearm parts separately to assembly the firearm. The receivers and frames are traditionally made from metal, but now are also being made from a polymer material. Receivers and frames made of the polymer material sometimes require additional parts to be used with the parts to be installed. Typically, these parts are made from metal and can include such components as slide rails and receiver stiffeners.

It is an object of the present invention to provide one component that adds both a rail and a trigger mechanism receiver as one part to be assembled in a frame or receiver.

SUMMARY OF THE INVENTION

The present invention provides a pistol with a frame having a rear grip, a trigger facility forward of the grip and an upper surface. An elongated slide is connected to the frame and operable to reciprocate along the upper surface. The frame defines a rear recess open at the upper surface. An insert is included having a major portion removably received in the rear recess and having a frame rail extending from the major portion above the upper surface. The frame rail is adapted to connect with the slide to constrain reciprocation.

DESCRIPTION OF THE CURRENT EMBODIMENT

Figure 1:
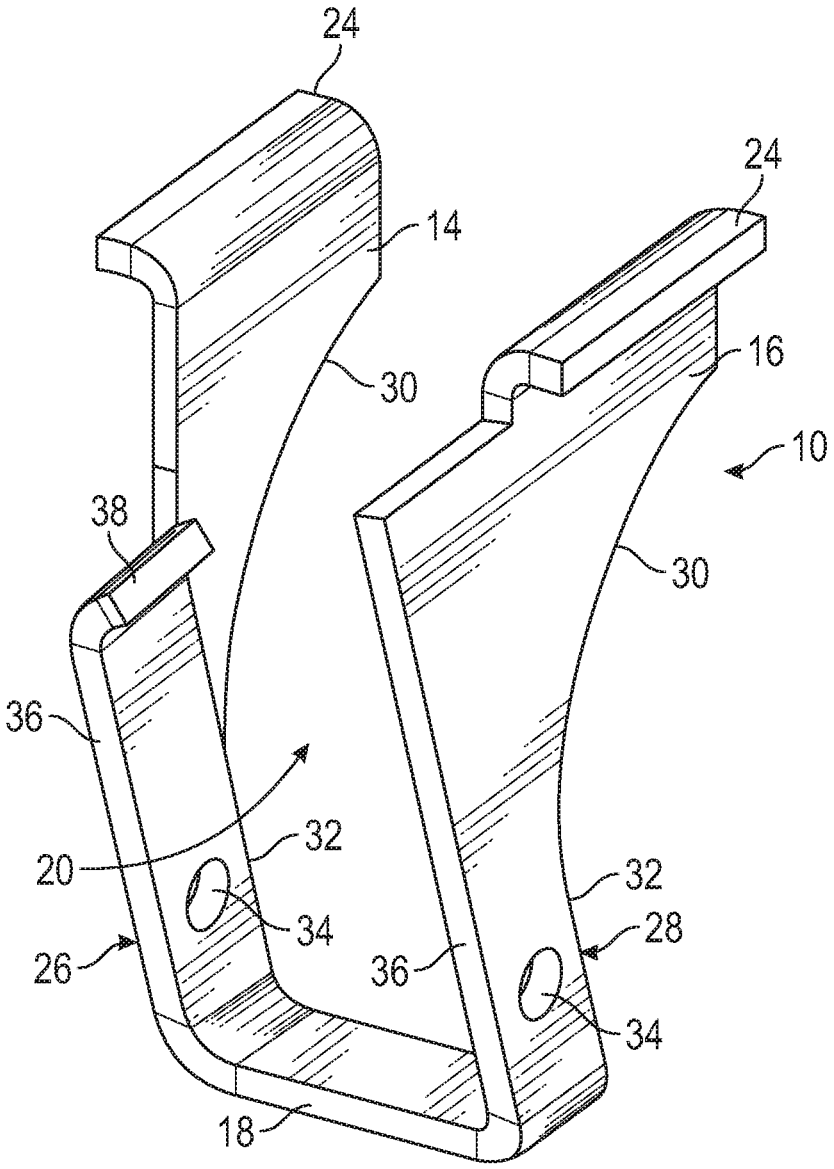
FIG. 1 is a front perspective view of a rear rail insert according to the present invention.
Figure 2:
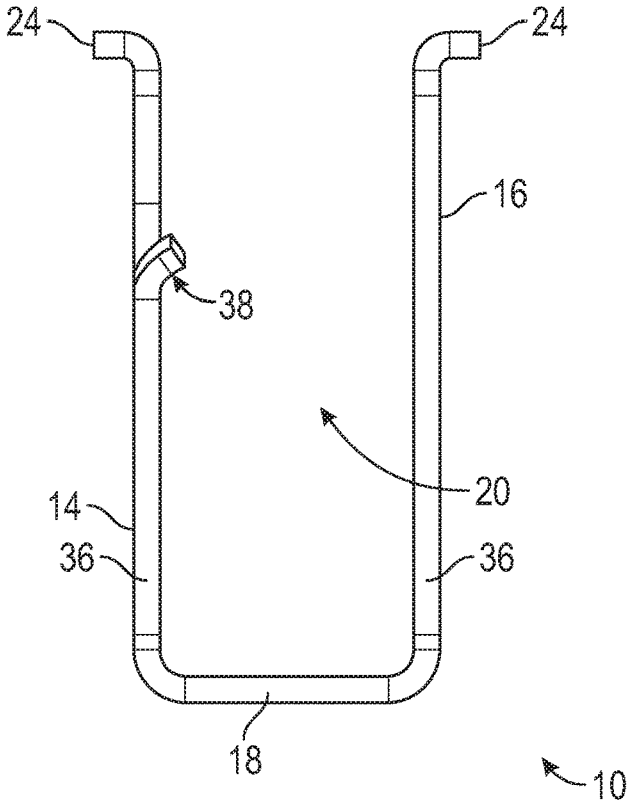
FIG. 2 is a front view of a rear rail insert according to the present invention.
Figure 3:
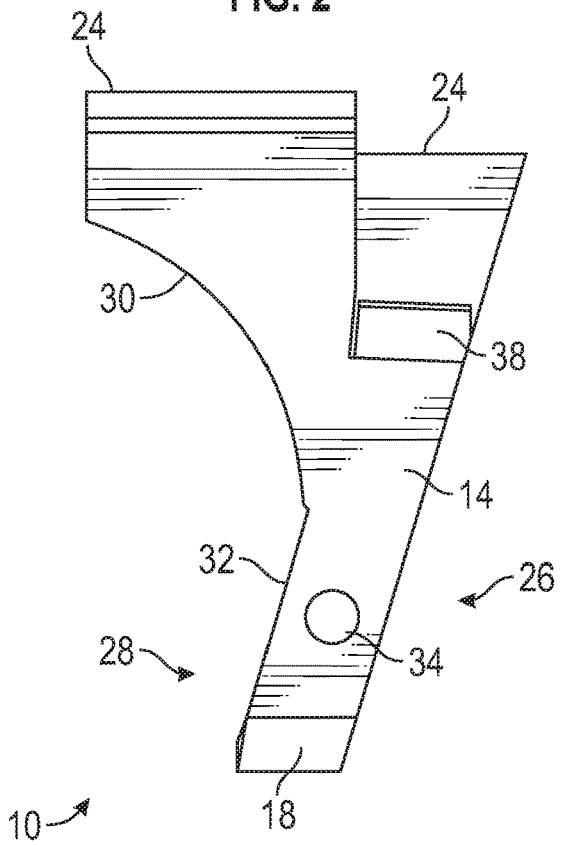
FIG. 3 is a right side view of a rear rail insert according to the present invention.
Figure 4:
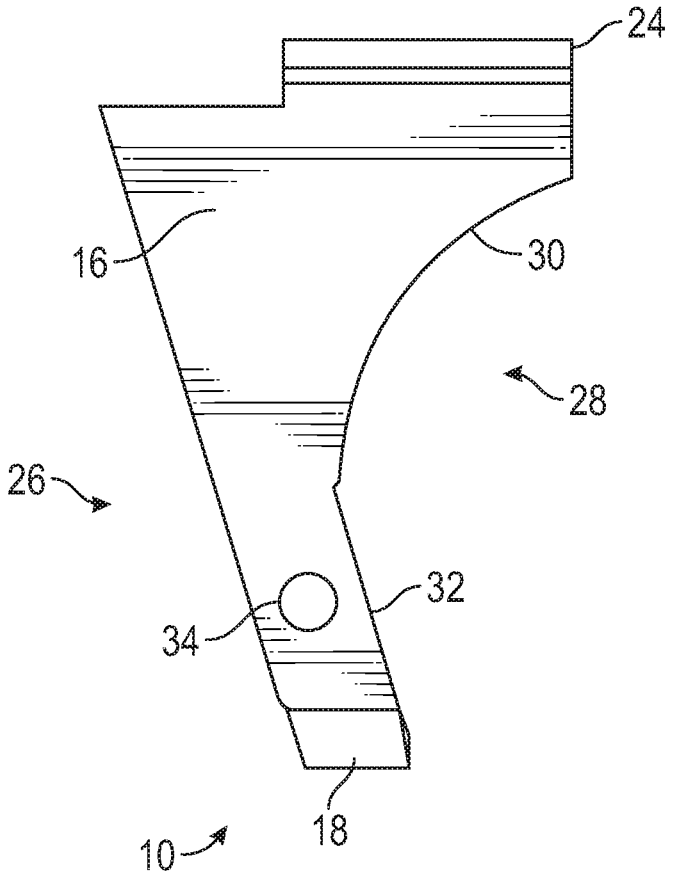
FIG. 4 is a left side view of a rear rail insert according to the present invention.

FIGS. 1-8 show a rear rail insert 10 that mounts in a pistol frame. FIG. 1 shows a front perspective view and FIG. 2 shows a front view of the rear rail insert 10. FIG. 3 shows a right side view 10 and FIG. 4 shows a left side view of the rear rail insert 10. The pistol frame 12 is shown in FIGS. 5-8. The rear rail insert 10 is a U-shaped frame with a right side 14, left side 16, and a cross member (span) 18 that constitute a major portion of the rear rail insert. The right side 14 and left side 16 are opposed parallel vertical elongated portions connected to each other only at their lowermost ends by a span, which is cross member 18. The U-shape open space formed by the right side 14, left side 16, and cross member 18 defines a housing receiving area 20 to receive a trigger mechanism housing 22. The cross member 18 is mounted near the bottom of the right side 14 and left side 16. The cross member 18 provides support, strength, and alignment to the right side 14 and the left side 16 to form the one piece frame. The rear rail insert 10 includes a rear rail (frame rail) 24 at the top of each of the right side 14 and the left side 16. The rear rails 24 extend upward and outward from each of the right side 14 and the left side 16 to provide a rail surface to engage a groove of a pistol slide. The rear rails 24 are a guide for movement of the pistol slide along the pistol frame 12.

The right side 14 and the left side 16 each include a front contact edge 26 and a rear contact edge 28. The rear contact edge 28 of both the right side 14 and the left side 16 includes a trigger housing pocket radius 30 which curves along the rear contact edge 28 of each of the right side 14 and the left side 16. The rear contact edge 28 of both the right side 14 and the left side 16 each have a rear straight edge 32 from the trigger housing pocket radius 30 to the cross member 18. The right side 14 and the left side 16 each include a pin hole 34 near the bottom of the right side 14 and the left side 16. The front contact edge 26 of both the right side 14 and the left side 16 each include a front straight edge 36 on a front of the right side 14 and the left side 16. The front straight edge 36 and the rear straight edges 32 extend from the cross member 18 at an angle and are parallel to each other. The right side 14 includes an index tab 38 along the front contact edge 26, where the index tab 38 extends into the housing receiving area 20.

Figure 5:
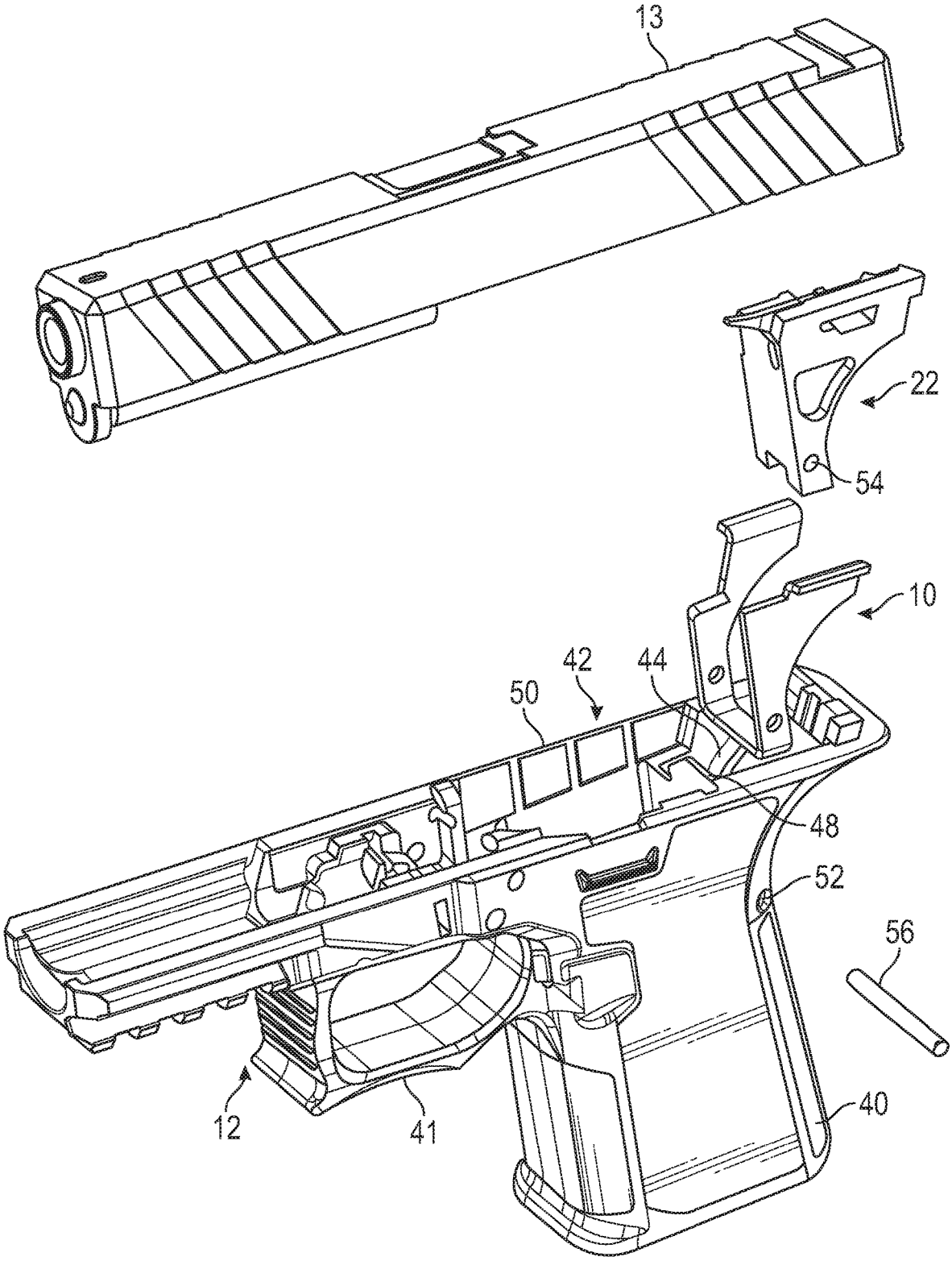
FIG. 5 is a perspective exploded view of a rear rail insert and a pistol according to the present invention.
Figure 6:
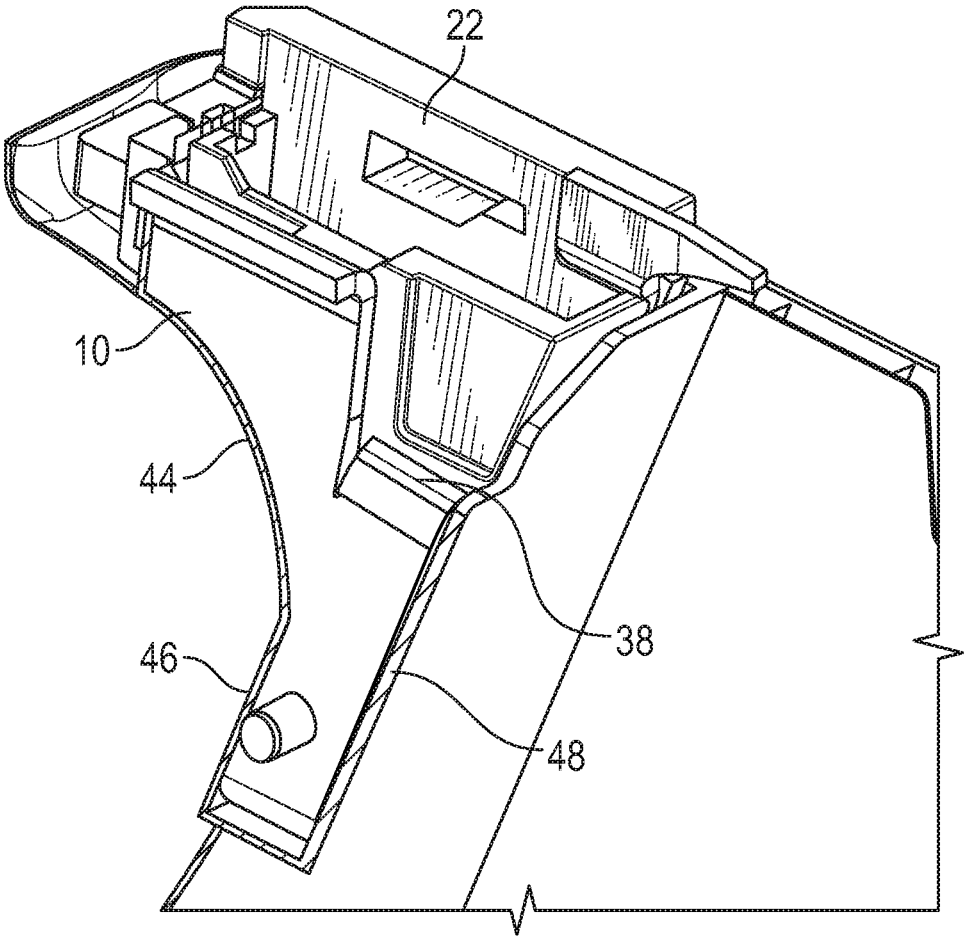
FIG. 6 is a perspective right side view of a rear rail insert and a pistol according to the present invention.
Figure 7:
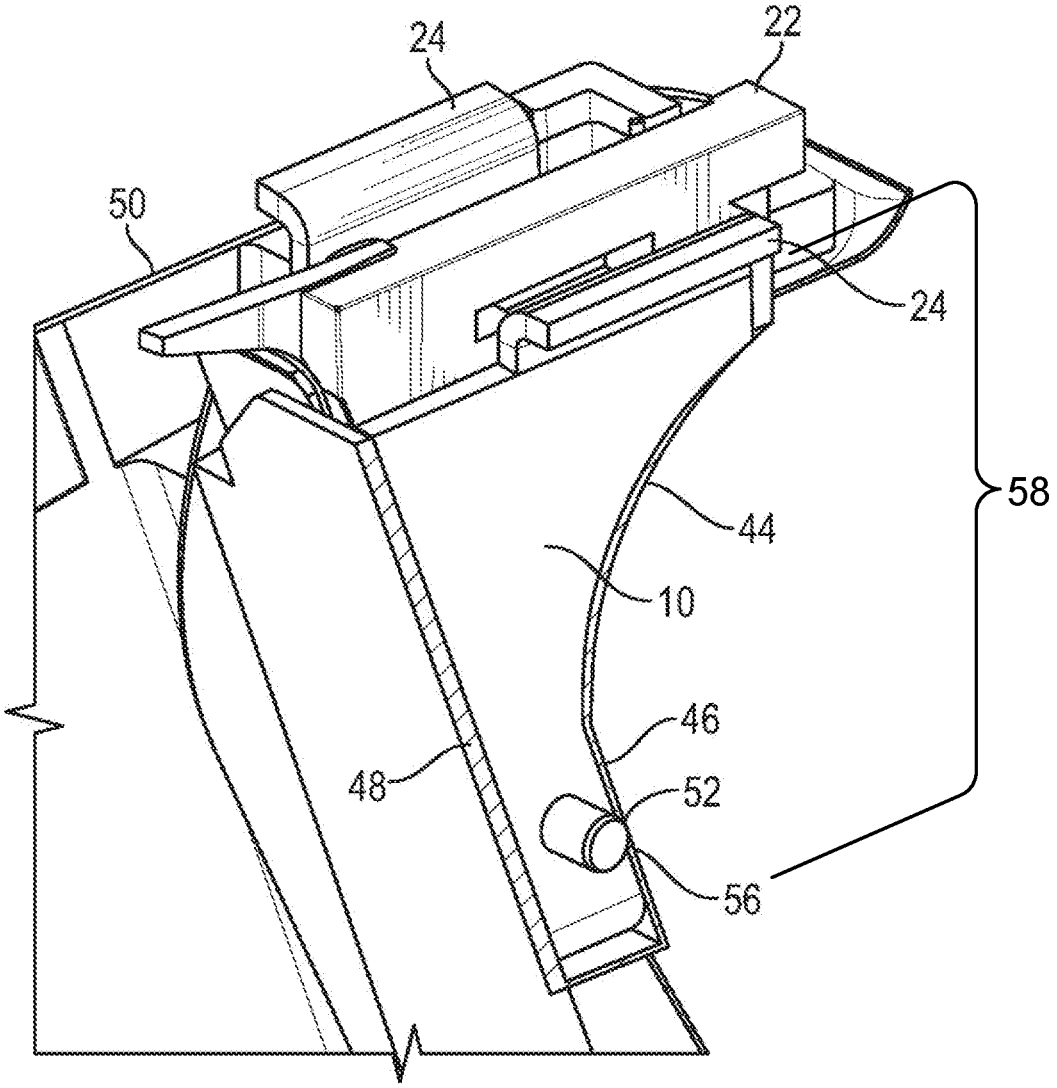
FIG. 7 is a perspective left side view of a rear rail insert and a pistol according to the present invention.

FIGS. 5-7 show the rear rail insert 10 installed into the pistol frame 12 made of polymer. FIG. 5 shows a pistol having an elongated slide 13 and a pistol frame 12 having a rear grip 40, a trigger facility 41 forward of the rear grip 40 and an upper surface 50. The slide 13 is connected to the pistol frame 12 and operable to reciprocate along the upper surface 50. An internal area of a pistol grip 40 of the pistol frame 12 includes a rear rail insert recess 42. The rear rail insert recess 42 is an open area to receive the rear rail insert 10 having opposed parallel sidewalls. The rear rail insert recess 42 includes rear contact surfaces and front contact surfaces that match the angles, shapes and curves of the front contact edges 26 and the rear contact edges 28 of the right side 14 and the left side 16 of the rear rail insert 10. FIGS. 5-7 show rear curved contact surfaces 44 and rear straight contact surfaces 46. The rear curved contact surfaces 44 match the trigger housing pocket radius 30, which curve along the rear contact edge 28 of the right side 14 and the left side 16. The rear straight contact surfaces 46 match the rear straight edges 32 of the right side 14 and the left side 16. Front straight contact surfaces 48 match the front straight edges 36 of the right side 14 and the left side 16. The rear rail insert 10 is dropped into the rear rail insert recess 42 of the pistol grip 40, where the rear rail insert 10 is mounted in place against the front contact surfaces 48 and the rear contact surfaces 44, 46 of the rear rail insert recess 42. The rear rail insert 10 is locked between the front contact surfaces 48 and the rear contact surfaces 44, 46 of the rear rail insert recess 42 when inserted. The rear rails 24 are shown in FIGS. 5-7 to extend above an upper surface 50 of the pistol frame 12 to receive the pistol slide 13 and are adapted to connect with the slide 13 to constrain reciprocation. A major portion 58 of the rear rail insert 10 is located below the upper surface 50 and within the rear rail insert recess 42.

Figure 8:
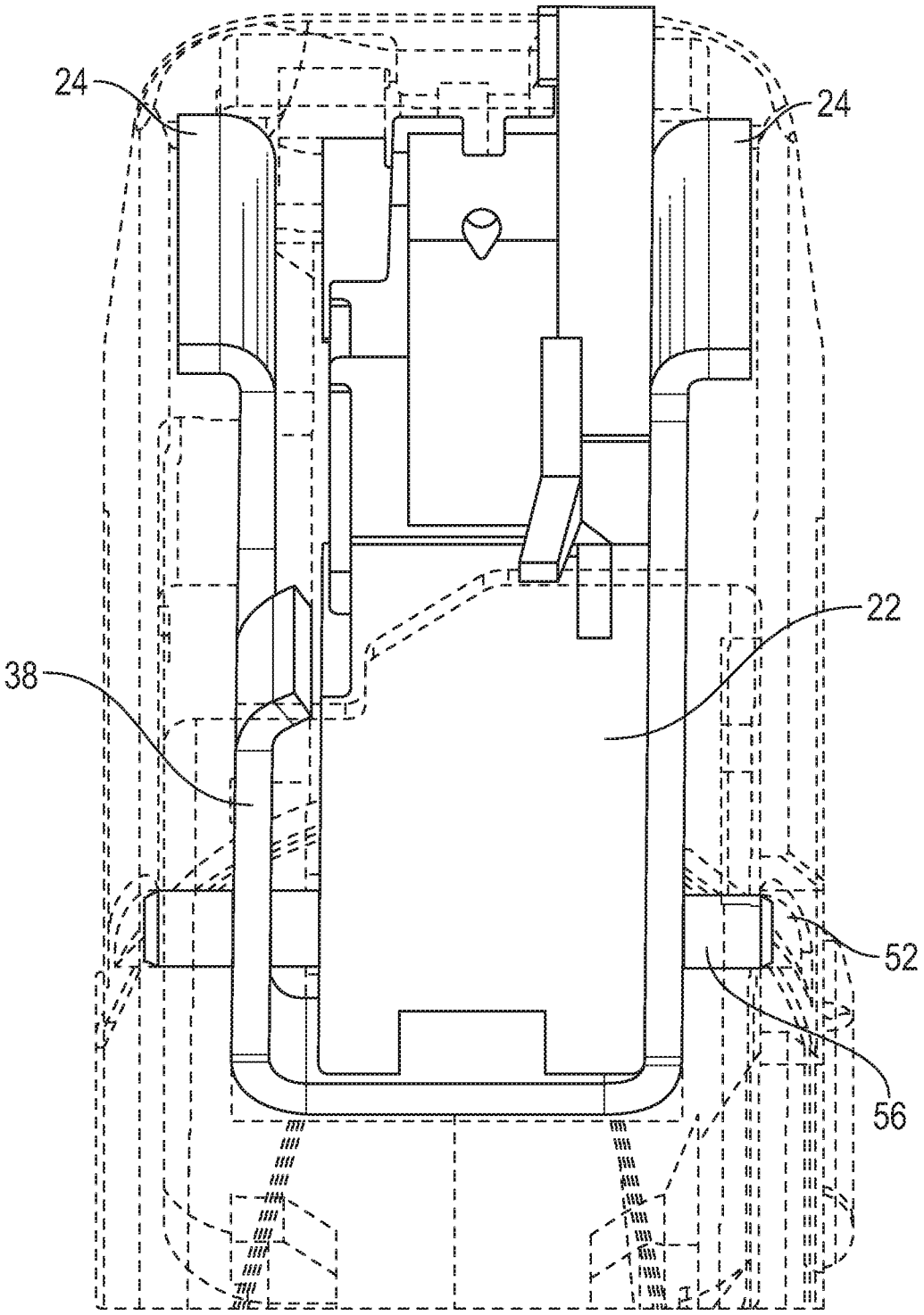
FIG. 8 is a front cutaway view of a rear rail insert and a pistol according to the present invention.

The trigger mechanism housing 22 is shown inserted into the housing receiving area 20 of the rear rail insert 10 in FIGS. 5-8. The pistol grip 40 includes a pin hole 52 and the trigger mechanism housing 22 includes a pin hole 54. When the trigger mechanism housing 22 is inserted into the housing receiving area 20, the pin holes 34 of the rear rail insert 10, the pin holes 52 of the pistol grip 40 and the pin hole 54 of the trigger mechanism housing 22 all align. A pin 56 is inserted into the pin holes 34 of the rear rail insert 10, the pin holes 52 of the pistol grip 40 and the pin holes 54 of the trigger mechanism housing 22 to secure the rear rail insert 10 and the trigger mechanism housing 22 in the pistol frame 12. When the trigger mechanism housing 22 is mounted in the pistol grip 10, the trigger mechanism housing 22 must be oriented in a particular manner. FIG. 8 shows the trigger mechanism housing 22 closer to the left side 16. The index tab 38 forces the trigger mechanism housing 22 toward the left side 16 when the trigger mechanism housing 22 is inserted into the housing receiving area 20 due to the index tab 38 occupying space on the right side of the housing receiving area 20.

The rear rail insert 10 is a component inserted into a pistol frame 12 that serves two key functions in a single component. The rear rail insert 10 allows the trigger mechanism housing 22 on to be inserted in between, and then locked in in place using a pin 56 that is inserted into the pistol frame 12. The rear rail insert 10 also serves as a guide with slide rear rails 24 for the pistol slide 13. The end user, after acquiring a pistol frame 12, takes a trigger mechanism housing 22, inserts it into the rear rail insert 10, then slides it down into the appropriate rear section of the pistol frame 12. A steel or plastic pin 56 is then driven through one of the pin holes 52 in the frame and into pin holes 34, 54 that align to each other, in the rear rail insert 10 and the trigger mechanism housing 22 to seat and affix the rear rail insert 10 and the trigger mechanism housing 22 to the pistol frame 12.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

We claim:

1. A pistol, comprising:

a frame having a rear grip, a trigger facility forward of the grip and an upper surface;

an elongated slide connected to the frame and operable to reciprocate along the upper surface;

the frame defining a rear recess open at the upper surface;

a unitary insert having a major lower portion removably received in the rear recess and having a pair of opposed frame rails extending from the major portion above the upper surface, the frame rail adapted to connect with the slide to constrain reciprocation; and the rear recess having a rear wall with a forward-facing wall surface, and the major lower portion of the unitary insert having a rear surface abutting the forward-facing wall surface.

2. The pistol of claim 1 wherein the rear recess of the frame has opposed parallel sidewalls, and the insert is closely received between the sidewalls.

3. The pistol of claim 1 wherein the insert has opposed parallel vertical elongated portions connected to each other by a span, and each having a frame rail at its upper end.

4. The pistol of claim 3 wherein the span connects to a peripheral edge portion of each vertical elongated portion.

5. The pistol of claim 3 wherein the span and the vertical elongated portions are each planar elements having a common thickness.

6. The pistol of claim 5 wherein the frame rails have the common thickness.

7. The pistol of claim 3 wherein each of the vertical elongated portions has a lower end and wherein the span is connected to each of the vertical elongated portions at a location closer to the lower end than to the frame rail.

8. The pistol of claim 3 further including an aperture defined in each vertical elongated portion adjacent to the lower end, and a corresponding hole in the frame registered with the apertures.

9. The pistol of claim 3 wherein the vertical elongated portions each have respective front and rear edges, and wherein the recess has respective front and rear ends closely abutting the front and rear edges of the vertical elongated portions.

10. The pistol of claim 1 wherein the vertical elongated portions have a length greater than a length of the frame rails.

* * * * *